US011230932B2

(12) United States Patent
Iida et al.

(10) Patent No.: US 11,230,932 B2
(45) Date of Patent: Jan. 25, 2022

(54) TURBINE BLADE AND GAS TURBINE

(71) Applicant: MITSUBISHI HEAVY INDUSTRIES, LTD., Tokyo (JP)

(72) Inventors: Koichiro Iida, Tokyo (JP); Ryuta Ito, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 23 days.

(21) Appl. No.: 16/366,327

(22) Filed: Mar. 27, 2019

(65) Prior Publication Data

US 2019/0301287 A1 Oct. 3, 2019

(30) Foreign Application Priority Data

Mar. 29, 2018 (JP) ..... JP2018-064577

(51) Int. Cl.
*F01D 5/20* (2006.01)
*F01D 5/18* (2006.01)

(52) U.S. Cl.
CPC ..... *F01D 5/20* (2013.01); *F01D 5/186* (2013.01); *F05D 2220/32* (2013.01); *F05D 2240/307* (2013.01); *F05D 2260/202* (2013.01)

(58) Field of Classification Search
CPC . F01D 5/20; F01D 5/186; F01D 5/187; F01D 11/08; F01D 11/02; F05D 2220/32; F05D 2240/307; F05D 2260/202
See application file for complete search history.

(56) References Cited

U.S. PATENT DOCUMENTS 5,261,789 A 11/1993 Butts et al.
5,564,902 A 10/1996 Tomita
5,660,523 A 8/1997 Lee
6,059,530 A * 5/2000 Lee ..... F01D 5/145 416/96 A (Continued)

FOREIGN PATENT DOCUMENTS

CN 102943694 2/2015
EP 3 216 983 9/2017

(Continued)

OTHER PUBLICATIONS

Y. C. Nho et al., "Effect of Tip Shape on the gas Turbine Blade Tip Heat Transfer", J. of thermophysics and Heat Transfer, vol. 26, Apr.-Jun. 2012.

*Primary Examiner* — Woody A Lee, Jr.
*Assistant Examiner* — Eric A Lange
(74) *Attorney, Agent, or Firm* — Wenderoth, Lind & Ponack, L.L.P.

(57) ABSTRACT

A turbine blade includes a blade body including a top plate at a tip portion which is outside of a turbine rotor in a radial direction of the turbine blade and has an outer surface configured to face an inner circumferential surface of a casing, and a tip thinning which protrudes radially outward in the radial direction of the turbine blade from the outer surface of the top plate and extends from a leading edge side of the blade body to a trailing edge side of the blade body. A protrusion amount of the tip thinning based on the outer surface of the top plate is 0.25 times or more and 2.00 times or less a diameter of a discharge port of a cooling hole which passes through the top plate.

18 Claims, 7 Drawing Sheets

(56) References Cited

U.S. PATENT DOCUMENTS

| | | | | |
|---|---|---|---|---|
| 6,164,914 | A * | 12/2000 | Correia | F01D 5/187 416/97 R |
| 6,502,304 | B2 * | 1/2003 | Rigney | F01D 11/14 29/889.21 |
| 8,061,987 | B1 * | 11/2011 | Liang | F01D 5/187 416/92 |
| 8,684,691 | B2 | 4/2014 | Lee et al. | |
| 2002/0197160 | A1 * | 12/2002 | Liang | F01D 5/20 416/92 |
| 2004/0096328 | A1 * | 5/2004 | Soechting | F01D 5/187 416/92 |
| 2007/0258815 | A1 * | 11/2007 | Liang | F01D 5/20 416/97 R |
| 2010/0111704 | A1 | 5/2010 | Hada | |
| 2014/0322028 | A1 * | 10/2014 | Grohens | F01D 5/187 416/97 R |
| 2015/0330229 | A1 * | 11/2015 | Zelesky | F01D 9/02 415/1 |
| 2018/0340426 | A1 * | 11/2018 | Mongillo | F01D 5/20 |

FOREIGN PATENT DOCUMENTS

| | | |
|---|---|---|
| JP | 3137527 | 2/2001 |
| JP | 2001-73704 | 3/2001 |
| JP | 5031103 | 9/2012 |

* cited by examiner

TURBINE BLADE AND GAS TURBINE

CROSS-REFERENCE TO RELATED APPLICATION

Priority is claimed from Japanese Patent Application No. 2018-064577, filed Mar. 29, 2018, the content of which is incorporated herein by reference.

BACKGROUND OF THE INVENTION

Field of the Invention

The present invention relates to a turbine blade and a gas turbine.

Description of Related Art

A gas turbine includes a compressor, a combustor, and a turbine. The turbine has a plurality of vanes and blades (turbine Wades).

In a gas turbine, the temperature of a combustion gas acting on the plurality of vanes and blades reaches a high temperature of 1500° C. Therefore, the vanes and blades have cooling passages and cooling holes therein through which a cooling medium flows. The vanes and blades cool blade walls with the cooling medium and cool blade surfaces by causing the cooling medium discharged from the cooling holes provided in the blade walls to flow out to the combustion gas side.

A constant gap is formed between tip portions of the blades and a ring segment (a part of a casing) forming the casing so that the tip portions and the ring segment do not interfere with each other. When the gap is too large, some of the combustion gas passes over blade tip portions and flows downstream, and thus tip leakage increases. As the tip leakage increases, energy loss increases, and thus thermal efficiency of the gas turbine decreases.

Also, when the gap is too narrow, blade bodies of the blades may come into contact with the ring segment, and thus the blade bodies may be damaged.

Therefore, conventionally, tip-thinning portions (also referred to as "squealer tips") are provided at tip portions of the blade bodies to suppress outflow of the combustion gas from the gap and damage to the blade bodies. However, since the tip-thinning portions are heated from three directions, that is, both side surfaces of the tip-thinning portions and top surfaces of the tip-thinning portions, a heat load is large. Therefore, in order to protect the up-thinning portions from heat, cooling of the tip-thinning portions has been performed (refer to, for example, U.S. Pat. No. 5,261,789).

U.S. Pat. No. 5,261,789 closes a blade having a tip-thinning portion which is formed on a pressure side of a top plate and a cooling hole which passes through a lower end of the tip-thinning portion and the top plate and is inclined so that the cooling medium can be discharged to the pressure side pressure surface side).

SUMMARY OF THE INVENTION

However, in the specification of U.S. Pat. No. 5,261,789, since the cooling hole is formed to pass through the lower end of the tip-thinning portion and the top plate, the cooling medium is discharged from a part of the tip-thinning portion.

As a result, since the discharged cooling medium can easily flow to the casing side along a wall surface of the tip-thinning portion, the cooling medium may flow away from an outer surface the top plate.

Thus, it was difficult to cool the top plate located closer to a suction side than the tip-thinning portion due to a film-cooling effect using the cooling medium discharged from the cooling hole.

That is, since a separate cooling medium for cooling the top plate located closer to the suction side than the tip-thinning portion is required, there was a problem in that the amount of cooling medium used to cool the blade body was unable to be reduced.

Accordingly, an object of the present invention is to provide a turbine blade and a gas turbine which can reduce the amount of cooling medium used to cool a blade body.

In order to solve the above-described problem, a turbine blade of one aspect of the present invention includes a blade body including a pressure-surface-side blade wall and a suction-surface-side blade wall extending in a radial direction of a turbine rotor and are connected to each other at a leading edge and a trailing edge, and a top plate having an outer surface facing an inner circumferential surface of a casing and provided at a tip portion, among end portions of the pressure-surface-side blade wall and the suction-surface-side blade wall, which is disposed at an outside of the turbine rotor in the radial direction, and a tip-thinning portion protruding outward in the radial direction of the turbine rotor from the outer surface of the top plate to the pressure-surface-side blade wall side of the top plate and extends from a leading edge side to a trailing edge side of the blade body, wherein the blade body includes a cooling hole formed to pass through the top plate, an introduction port formed at a position of an inner surface of the top plate facing the tip-thinning portion or formed at a position thereof closer to the suction-surface-side blade wall side than the position facing the tip-thinning portion and configured to introduce a cooling medium into the cooling hole, and a discharge port formed in the outer surface of the top plate on the pressure-surface-side blade wall side than the tip-thinning portion and configured to discharge the cooling medium via the cooling hole, and a protrusion amount of the tip-thinning portion based on the outer surface of the top plate is 0.25 times or more and 2.00 times or less the diameter of the discharge port of the cooling hole.

According to the present invention, since the introduction port formed at a position of the inner surface of the top plate facing the tip-thinning portion or formed at a position thereof closer to the suction-surface-side blade wall side than the position facing the tip-thinning portion and configured to introduce a cooling medium into the cooling hole, and the discharge port formed in the outer surface of the top plate on the pressure-surface-side blade side of the tip-thinning portion and configured to discharge the cooling medium via the cooling hole are provided, the cooling medium can be discharged upstream of the tip-thinning portion and can flow along the protruding surface of the tip-thinning portion and the outer surface of the top plate located closer to the suction-surface-side blade wall side than the tip-thinning portion.

Thus, since it is possible to film-cool the outer surface of the top plate located closer to the suction-surface-side blade wall side than the tip-thinning portion and the tip-thinning portion using the cooling medium discharged from the discharge port, the amount of cooling medium used to cool the blade body of the turbine blade can be reduced.

Further, since the introduction port which is formed at the position facing the tip-thinning portion or the position closer to the suction-surface-side blade wall side than the position facing the tip-thinning portion and introduces the cooling medium into the cooling hole is provided, it is possible to reduce a distance between the cooling hole and the tip-thinning portion in the radial direction of the turbine rotor, and thus the tip-thinning portion can be cooled from the inside thereof using the cooling medium flowing through the cooling hole passing through the top plate. Accordingly, the tip-thinning portion carp be cooled efficiently.

Further; in the turbine blade according to one aspect of the resent invention, the tip-thinning portion may be provided only on the pressure-surface-side blade side of the top plate.

As described above, the film-cooling effect can be enhanced by providing the tip-thinning portion on the pressure-surface-side blade wall side of the top plate.

Further; in the turbine blade according to one aspect of the present invention, the outer surface of the top plate may extend in a planar shape from the tip-thinning portion toward the suction-surface-side blade wait side.

As described above, since the outer surface of the top plate extends in a planar shape from the tip-thinning portion toward the suction-surface-side blade wall side, the cooling medium which has passed through the tip-thinning portion flows along the outer surface of the top plate toward the suction-surface-side blade wall side, and thus the film-cooling effect can be enhanced.

Further, in the turbine blade according to one aspect of the present invention, a plurality of cooling holes may be formed in a direction from the leading edge side to the trailing edge side of the blade body.

As described above, since the plurality of cooling holes are formed in the direction from the leading edge side to the trailing edge side of the blade body, it is possible to film-cool the entire outer surface of the top plate located closer to the suction-surface-side blade wall side than the tip-thinning portion using the cooling medium discharged from the discharge ports of the plurality of cooling holes.

Further, in the turbine blade according to one aspect of the present invention, the top plate may have an inclined surface which is disposed on an outside of the outer surface to surround the outer surface and inclined with respect to the outer surface.

As described above, since the top plate has the inclined surface which is disposed to surround the outside of the outer surface of the top plate and inclined with respect to the outer surface, the temperature of a portion in which the inclined surface is formed can be prevented from being too high.

Further, according to the turbine blade of one aspect of the present invention, an angle between the outer surface of the top plate located closer to the suction-surface-side blade wall side than the tip-thinning portion and an axis of the cooling hole may be 25° or more and 65° or less.

For example, when the angle between the outer surface of the top plate and the cooling hole is smaller than 25°, it may be difficult to machine the cooling hole.

On the other hand, when the angle between the outer surface of the top plate and the cooling hole is greater than 65°, the cooling medium discharged from the cooling hole flows away from the protruding surface of the tip-thinning portion, and thus it may be difficult to obtain the film-cooling effect.

Therefore, since the angle between the outer surface of the top plate located closer to the suction-surface-side blade wall side than the tip-thinning portion and the cooling hole is set to be 25° or more and 65° or less, it is possible to film-cool me outer surface of the top plate located closer to the suction-surface-side blade wall side than the tip-thinning portion while easily machining the cooling holes.

Further, according to the turbine blade of one aspect of the present invention, the protrusion amount of the tip-thinning portion based on the outer surface of the top plate may be 0.25 times or more and 2.00 times or less the diameter of the discharge port of the cooling hole.

The cooling medium from the cooling hole located closer to the pressure-surface-side blade wall side than the tip-thinning portion can flow along the tip-thinning portion and the outer surface of the top plate located downstream thereof, and thus the film-cooling efficiency can be enhanced by making the tip-thinning portion protrude appropriately from the top plate.

When the protrusion amount of the tip-thinning portion is smaller than 0.25 times the diameter of the discharge hole of the cooling hole, an effect of enhancing the film-cooling effect is also small, and also since a gap between the top plate and the casing is narrowed, the possibility of contact with the top plate is increased, and the effect of providing the tip-thinning portion may be reduced.

On the other hand when the protrusion amount of the tip-thinning portion is larger than 2.00 times the diameter of the discharge port of the cooling hole, a distance between the discharge port of the cooling hole and tip portions of the top plate and the tip-thinning portion increases, the cooling medium is easily separated from the tip-thinning portion or the top plate and it may be difficult for the cooling medium to flow along the outer surface of the plate located on the suction-surface-side blade wall side.

Therefore while the effect of providing the tip-thinning portion is maintained, the outer surface of the top late located closer to the suction-surface-side blade wall side than the op-thinning portion can be cooled by setting the protrusion amount of the tip-thinning portion to be 0.25 times or more and 2.00 times or less the diameter of the discharge port of the cooling hole.

Further, according to the turbine blade of one aspect of the present invention, a width of the outer surface of the top plate located closer to the pressure-surface-side blade will side than the tip-thinning portion may be one times or more and three times or less the diameter of the discharge port or the cooling hole.

When the width of the outer surface of the top plate located close the pressure-surface-side blade wall side than the tip-thinning portion is smaller than one times the diameter of the discharge port of the cooling hole, it may be difficult to form the discharge port of the cooling hole in the outer surface of the top plate located closer to the pressure-surface-side blade wall side than the tip-thinning portion.

On the other hand, when the width of the outer surface of the top plate located closer to the pressure-surface-side blade wall side than the tip-thinning portion is larger than three times the diameter of the discharge port of the cooling hole, it may be difficult to efficiently cool the tip-thinning portion, or the temperature of the edge of the pressure-surface-side blade wall and the inclined surface may be too high because the distance between the cooling hole and the tip-thinning portion is too large.

Therefore, while the cooling holes are easily formed, the tip-thinning portion can be cooled efficiently, and the temperature of the inclined surface can be prevented from being too high by setting the width of the outer surface of the top plate located closer to the pressure-surface-side blade wall side than the tip-thinning portion to be 1 times or more and 3 times or less the diameter of the discharge port of the cooling hole.

Further, according to the turbine blade of one aspect of the present invention, a width of the inclined surface may be 0.25 times or more and 3.00 times or less the diameter of the discharge port of the cooling hole.

For example, when the width of the inclined surface is smaller than 0.25 times the diameter of the discharge port of the cooling hole, the temperature of the inclined surface or the edge may be too high due to heating from both the blade wall side and the top plate side at a position between the cooling hole and the cooling hole. On the other hand, when the width of the inclined surface is larger than 3.00 times the diameter of the discharge port of the cooling hole, the inclined surface in the vicinity of the pressure-surface-side blade wall may be away from the cooling hole, and the temperature thereof may become too high.

Therefore, an increase in temperature of the inclined surface or the edge can be prevented by setting the width of the inclined surface to be 0.25 times or more and 3.00 times or less the diameter of the discharge port of the cooling hole.

Further, according to the turbine blade of one aspect of the present invention, the plurality of cooling holes may include a cooling hole which is inclined with respect to a pressure surface that is an outer surface on the pressure-surface-side blade wall side and faces the leading edge side of the blade body or the trailing edge side of the blade body.

As described above, since the cooling medium discharged from the plurality of cooling holes can be made to flow along the side surface of the tip-thinning portion located on the pressure-surface-side blade wall side by including the cooling note which is inclined with respect to the pressure surface and faces the leading edge side of the blade body or the trailing edge side of the blade body, the film-cooling effect can be enhanced.

Further, according to the turbine blade of one aspect of the present invention, the turbine blade may further include a flow passage-forming member provided in the blade body and configured to form a flow passage in which a cooling medium flows in the blade body, and the flow passage-forming member may form the flow passage guiding the cooling medium to a boundary portion between the top plate and the suction-surface-side blade wall and then guides the cooling medium to the cooling hole As described above, since the flow passage-forming member which is provided in the blade body to guide the cooling medium to a boundary portion between the top plate and the suction-surface-side blade wall and then to guide the cooling medium to the cooling hole is provided, the inside of the boundary portion between the top plate and the suction-surface-side blade wall in which the temperature tends to be high can be cooled using the cooling medium discharged from the cooling hole.

Further, according to the turbine blade of one aspect of the present invention, the tip-thinning portion and the blade body may be integrally formed by machining a metallic substrate and may have a thermal barrier coating layer covering only an outer surface of the metallic substrate constituting the blade body.

As described above, since the thermal barrier coating layer covering only the outer surface of the metallic substrate constituting the blade body is provided, the thermal barrier coating on the blade body side can be protected by cutting the casing which is weaker than the tip-thinning portion.

Further, a gas turbine according to one aspect of the present invention includes a turbine including a turbine rotor on which the plurality of turbine blades are disposed in a circumferential direction and an axial direction, and the plurality of turbine blades, a compressor configured to suction combustion air and generates compressed air, a combustor configured to inject fuel into the compressed air to burn the fuel and to generate combustion gas for driving the turbine, and a casing including a ring segment facing the tip-thinning portions with a gap interposed therebetween, and configured to accommodate the turbine rotor and the plurality of turbine blades.

The gas turbine having such a constitution can reduce the amount of cooling medium used to cool the plurality of turbine blades.

According to the present invention, it is possible to reduce the amount of cooling medium used to cool the blade body of the turbine blade.

DETAILED DESCRIPTION OF THE INVENTION

A gas turbine 10 according to an embodiment of the present invention will be described with reference to FIG. 1.

Figure 1:
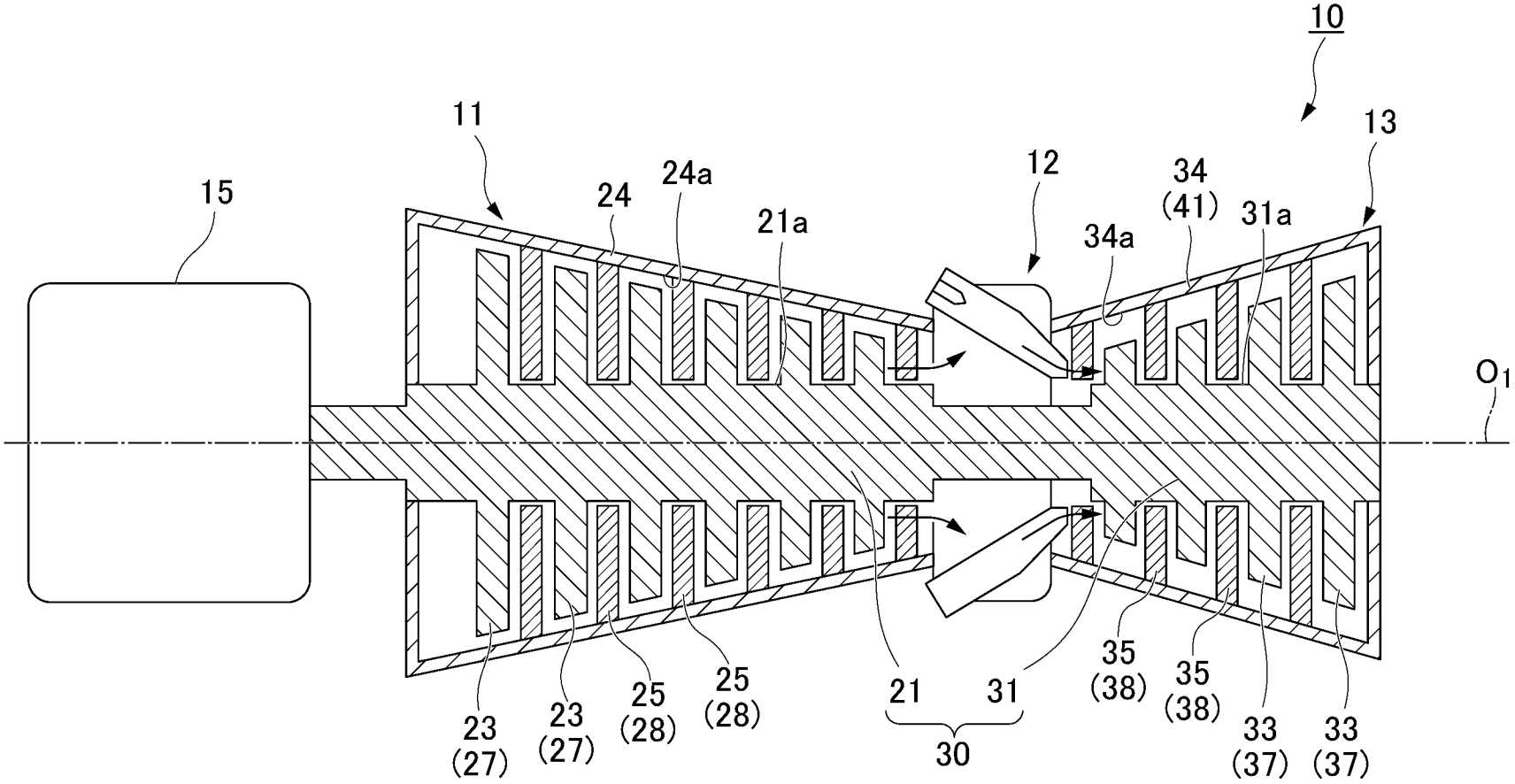
FIG. 1 is a cross-sectional view schematically showing a schematic constitution of a gas turbine according to an embodiment of the present-invention.

In FIG. 1, for convenience of explanation, a generator 15 which is not a component of the gas turbine 10 is also illustrated. In FIG. 1, $O_1$ indicates an axis of a rotor 30 (hereinafter referred to as "axis $O_1$"). The axis $O_1$ of the rotor 30 is also an axis of the turbine motor 31. In the following description, it may be called "the axis $O_1$ of the turbine rotor 31." Moreover, arrows shown in a compressor 11 of FIG. 1 show a flow direction of compressed air.

The gas turbine 10 includes a compressor 11, a combustor 12, and a turbine 13.

The compressor 11 includes a compressor rotor 21, a plurality of compressor blade stages 23, a compressor casing 24, and a plurality of compressor vane stages 25.

The compressor rotor 21 is a cylindrical rotating body. The compressor rotor 21 has an outer circumferential surface 21*a*. The compressor rotor 21 is connected to a turbine rotor 31 which constitutes the turbine 13. The compressor rotor 21 constitutes the rotor 30 together with the turbine rotor 31. The compressor rotor 21 rotates around the axis $O_1$.

The plurality of compressor blades 23 are arranged on the outer circumferential surface 21*a* of the compressor rotor 21 at intervals in a direction of the axis $O_1$. The compressor blade stages 23 have a plurality of compressor blades 27 arranged at intervals in a circumferential direction of the outer circumferential surface 21*a* of the compressor rotor 21. The plurality of compressor blades 27 rotate with the compressor rotor 21.

The compressor casing 24 accommodates the compressor rotor 21 and the plurality of compressor blade stages 23 in a state in which a gap is interposed between the compressor casing 24 and tip portions of the plurality of compressor blades 27.

The compressor casing 24 is a tubular member of which a central axis is the axis $O_1$. The compressor casing 24 has an inner circumferential surface 24*a*.

The plurality of compressor vane stages 25 are arranged on the inner circumferential surface 24*a* of the compressor casing 24 at intervals in the direction of the axis $O_1$. The plurality of compressor vane stages 25 are arranged so that the compressor blade stages 23 and the compressor vane stages 25 are alternately arranged when seen in the direction of the axis $O_1$. Each of the compressor vane stages 25 includes a plurality of compressor vanes 28 arranged at intervals in a circumferential direction of the inner circumferential surface 24*a* of the compressor casing 24.

The compressor 11 having such a constitution suctions combustion air and then generates compressed air. The compressed air generated by the compressor 11 flows into the combustor 12.

The combustor 12 is provided between the compressor 11 and the turbine 13. The combustor 12 generates a combustion gas by injecting fuel into the compressed air generated by the compressor 11. The high temperature combustion gas generated by the combustor 12 is introduced into the turbine 13 and drives the turbine 13.

The turbine 13 has a turbine rotor 31, a plurality of turbine blade stages 33, a turbine casing 34, and a plurality of turbine vane stages 35.

The turbine rotor 31 is a cylindrical rotating body. The turbine rotor 31 has an outer circumferential surface 31*a*. The turbine rotor 31 rotates around the axis $O_1$.

The plurality of turbine moving blade stages 33 are arranged on the outer peripheral surface 31*a* of the turbine rotor 31 with a gap in the direction of the axis $O_1$. Each of the turbine moving blade stages 33 has a plurality of turbine moving blades 37 arranged at intervals in the circumferential direction of the outer peripheral surface 21*a* of the turbine rotor 31. The plurality of turbine blades 37 rotate with the turbine rotor 31.

The turbine casing 34 accommodates the turbine rotor 31 and the plurality of turbine blade stages 33 in a state in which a gap is interposed between the turbine casing 34 and tip portions of the plurality of turbine blades 37.

The turbine casing 34 is a tubular member of which a center axis is the axis $O_1$. The turbine casing 34 has an inner circumferential surface 34*a*.

The turbine casing 34 has a ring segment 41 facing the tip portions of the plurality of turbine blades 37 with a gap interposed therebetween.

The plurality of turbine vane stages 35 are arranged on the inner circumferential surface 34*a* of the turbine casing 34 at intervals in the direction of the axis $O_3$. The plurality of turbine van stages are arranged so that the turbine blade stages and the turbine vane stages 35 are alternately errand when seen in the direction of the axis $O_1$.

The turbine vane stages 35 have a plurality of turbine vanes 38 arranged at intervals in the circumferential direction of the inner circumferential surface 34*a* of the turbine casing 34.

Figure 2:
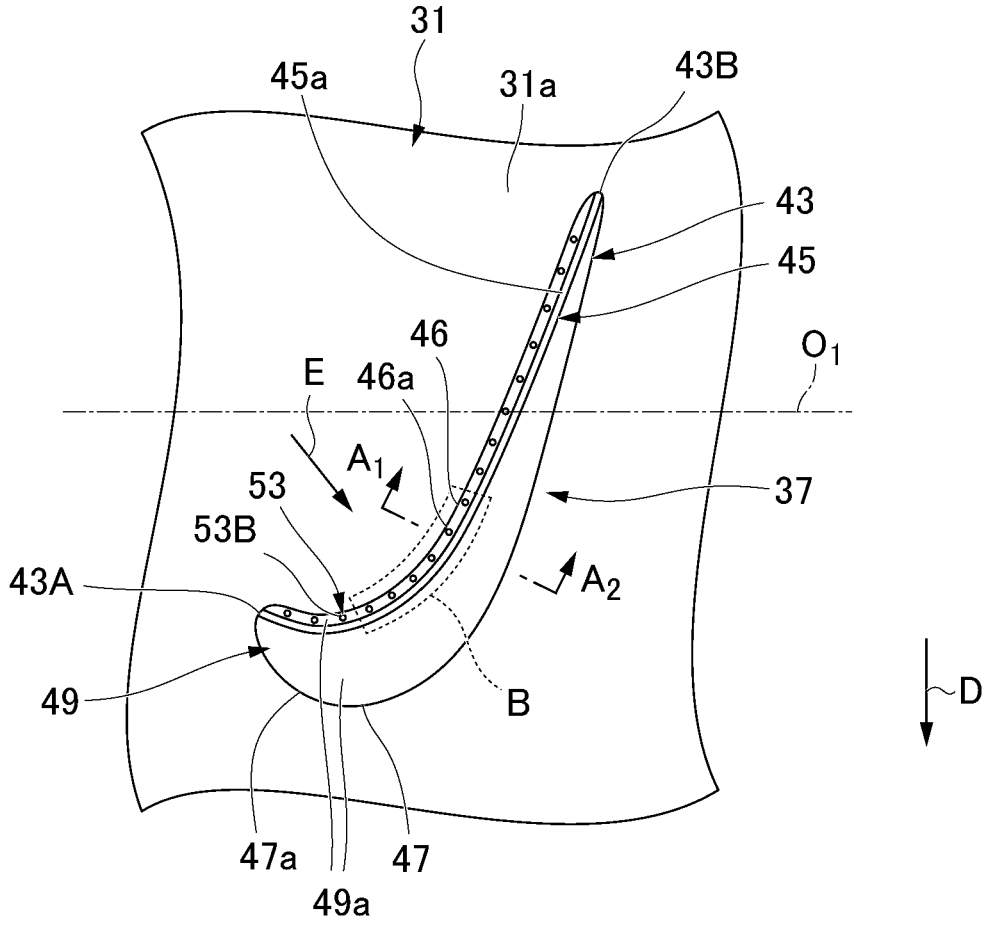
FIG. 2 is a schematic view of a turbine blade shown in FIG. 1 in a plan view when seen from the radially outer side of a turbine rotor.

A constitution of each of the turbine blades 3 of the embodiment will be described with reference to FIGS. 2 to 4. In FIG. 2, D indicates a rotation direction of the turbine rotor 31 (hereinafter referred to as "D direction"), and E indicates a flow direction of the combustion gas flowing between the ring segment 41 and the turbine blades 37 (hereinafter referred to as "E direction"). In FIG. 2, the same components as those of the structure shown in FIG. 1 are designated by the same reference numerals.

Figure 3:
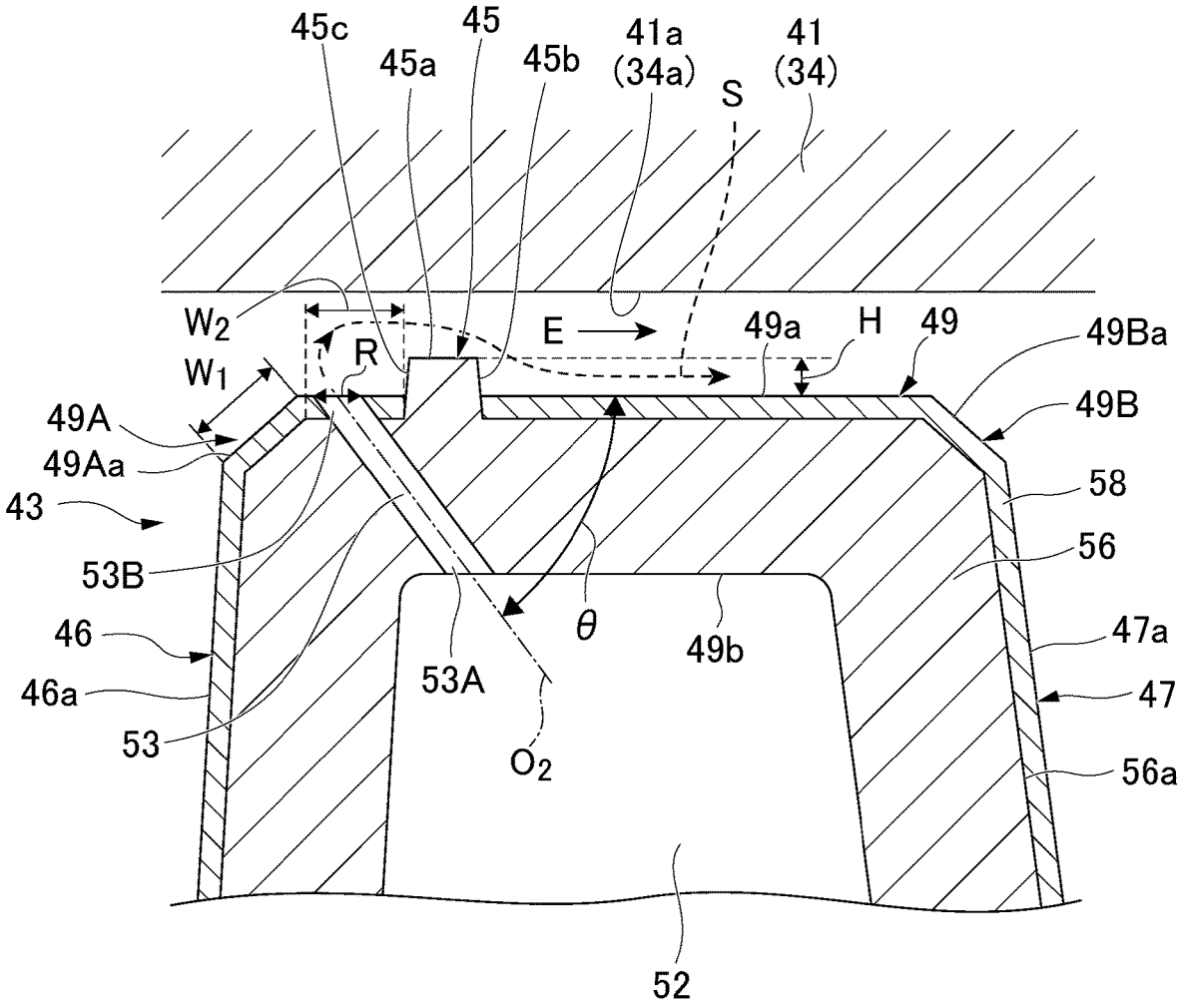
FIG. 3 is a cross-sectional view of the turbine blade shown in FIG. 2 taken along line $A_1$-$A_2$.
Figure 4:
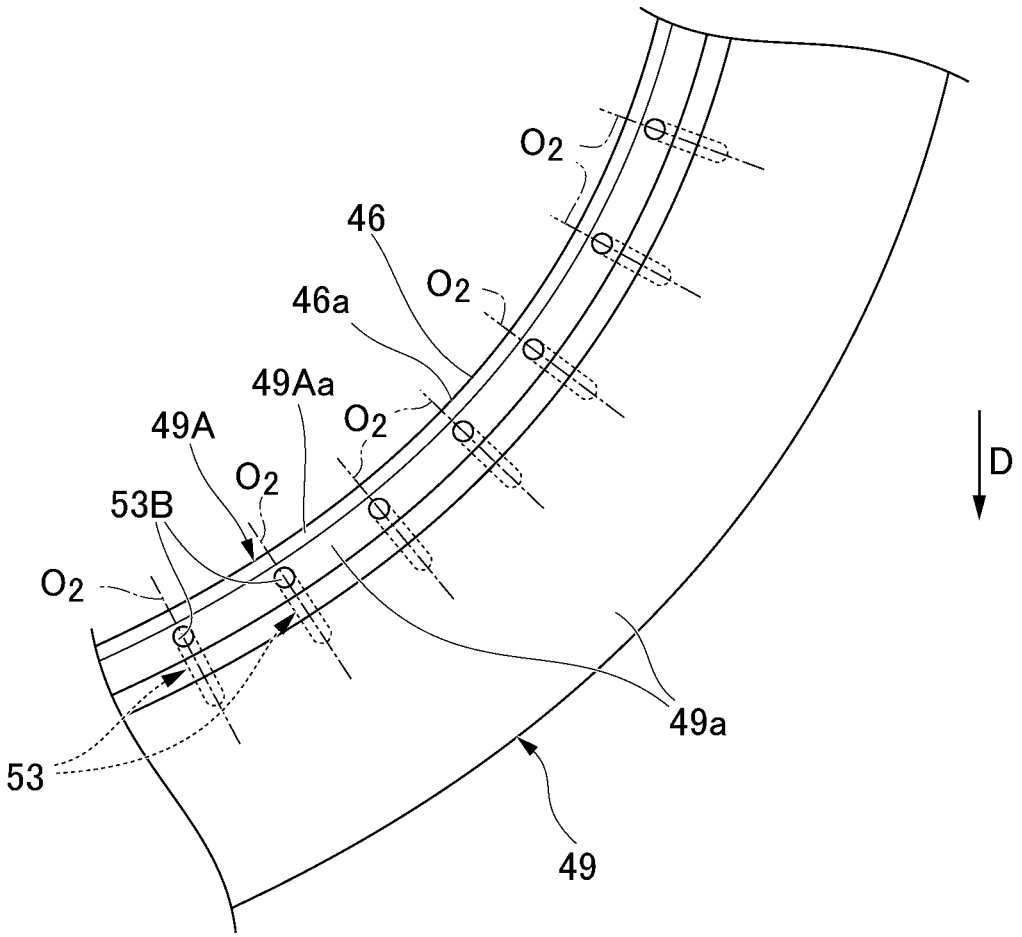
FIG. 4 is an enlarged view of a region B of the turbine blade shown in FIG. 2.

In FIG. 3, $O_2$ indicates an axis of a cooling hole 53 (hereinafter, referred to as "axis $O_2$"), R indicates a diameter (hereinafter, referred to as "diameter R") of a discharge port of the cooling hole 53, and θ indicates an angle (hereinafter, referred to as "inclination angle θ") formed by an outer surface 49*a* of a top plate 49 located on the suction-surface-side blade wall 47 side (suction side) and the axis of the cooling hole 53.

Further, in FIG. 3, H indicates a protrusion amount (hereinafter, referred to as "protrusion amount H") of a tip-thinning portion 45 with reference to the outer surface 49*a* of the top plate 49, $W_1$ indicates a width (hereinafter, "width $W_1$") of an inclined surface 49A*a* of a chamfered portion 49A, and $W_2$ indicates a width (hereinafter, referred to as "width $W_2$") of the outer surface 49*a* of the top plate 49 located closer to the pressure-surface-side blade wall 46 side (pressure side) than the tip-thinning portion 45.

Further, a dotted arrow S shown in FIG. 3 schematically shows a flow of a cooling medium discharged from the discharge port 53B of the cooling hole 53.

Further, in FIG. 3, the same components as those of the structure shown in FIG. 2 are designated by the same reference numerals. In FIG. 4, the same components as those shown in FIGS. 2 and 3 are designated by the same reference numerals.

Each of the turbine blades 37 of the embodiment includes a blade body 43 and a tip-thinning portion 45.

The blade body 43 includes a leading edge 43A, a trailing edge 43B, the pressure-surface-side blade wall 46, the suction-surface-side blade wall 47, the top plate 49, a cooling flow passage 52, and a cooling hole 53.

The pressure-surface-side blade wall 46 and the suction-surface-side blade wall 47 extend in a radial direction of the turbine rotor 31. Each of the pressure-surface-side blade wall 46 and the suction-surface-side blade wall 47 is formed to be curved. The pressure-surface-side blade wall 46 and the suction-surface-side blade wall 47 are connected to each other at the leading edge 43A and the trailing edge 43B.

The pressure-surface-side blade wall 46 has a pressure surface 46*a* which is an outer peripheral surface of the pressure-surface-side blade wall 46. The suction-surface-side blade wall 47 has a suction surface 47*a* which is an outer peripheral surface of the suction-surface-side blade wall 47. When the gas turbine 10 shown in FIG. 1 is driven and the turbine rotor 31 rotates in a D direction, the suction surface 47*a* receives a pressure lower than that in the pressure surface 46*a*.

The top plate 49 is provided at a tip portion, among end portions (specifically, base end portions and tip portions) of the pressure-surface-side blade wall 46 and the suction-surface-side blade wall 47, which is disposed on the outer side of the turbine rotor 31 in the radial direction.

The top plate 49 is a plate-shaped member and has an outer surface 49*a*, an inner surface 49*b*, and chamfered portions 49A and 49B.

The outer surface 49*a* of the top plate 49 faces the inner circumferential surface 34*a* of the turbine casing 34 (specifically, an inner circumferential surface 41*a* of the ring segment 41) and is shaped or flat along the inner circumferential surface 34*a* of the turbine casing 34.

The inner surface 49*b* of the top plate 49 is a surface disposed on the opposite side of the outer surface 49*a* and is exposed to the cooling flow passage 52 formed in the blade body 43.

The chamfered portion 49A is formed by chamfering a corner portion of the top plate 49 located on the pressure-surface-side blade wall 46 side. The chamfered portion 49A is formed from the leading edge 43A to the trailing edge 438 of the blade body 43.

The chamfered portion 49A has the inclined surface 49A*a* which is inclined with respect to the outer surface 49*a* of the top plate 49. Although FIG. 3 illustrates the case in which the inclined surface 49A*a* is a flat surface as an example, the inclined surface 49A*a* may be, for example, a curved surface having a convex shape.

A width $W_1$ of the inclined surface 49A*a* is preferably, for example, 0.25 times or more and 3.00 times or less a diameter R of the discharge port 53B of the cooling hole 53.

For example, when the width $W_1$ of the inclined surface 49A*a* is smaller than 0.25 times the diameter R of the discharge port 53B of the cooling hole 53, the temperature of the chamfered portion 49A (including the inclined surface 49A*a*) or an edge may be too high due to heating from both the blade wall side and the top plate 49 side at a position between the cooling hole 53 and the cooling hole 53. On the other hand, when the width $W_1$ of the inclined surface 49A*a* is larger than 3.00 times the diameter R of the discharge port 53B of the cooling hole 53, the inclined surface 49A*a* in the vicinity of the pressure-surface-side bade wall 46 may be away from the cooling hole 53, and the temperature thereof may become too high.

Therefore, an increase in temperature of the chamfered portion 49A (including the inclined surface 49A*a*) or the edge can be prevented by setting the width of the inclined surface 49A*a* to be 0.25 times or more and 3.00 times or less the diameter R of the discharge port 538 of the cooling hole 53.

More preferably, the width $W_1$ of the inclined surface 49A*a* is, for example, 0.5 times the diameter R of the discharge port 53B of the cooling hole 53.

The chamfered portion 49B is formed by chamfering a corner portion of the top plate 49 located on the suction-surface-side blade wall 47 side. The chamfered portion 49B is formed from the leading edge 43A to the trailing edge 43B of the blade body 43.

The chamfered portion 49B has an inclined surface 49B*a* which is inclined with respect to the outer surface 49*a* of the top plate 49. Although FIG. 3 illustrates the case in which the inclined surface 49B*a* is a flat surface as an example, the inclined surface 49B*a* may be, for example, a curved surface having a convex shape.

The above-described inclined surfaces 49A*a* and 49B*a* of the chamfered portions 49A and 49B are disposed to surround the outer surface 49*a* of the top plate 49. The temperature of the corner portion of the top plate 49 can be prevented from becoming too high due to the combustion gas by having the inclined surfaces 49A*a* and 49B*a* having such constitutions.

The pressure-surface-side blade wall 46, the suction-surface-side blade wall 47, and the top plate 49 described above are constituted to include a metallic substrate 56 and a thermal barrier coating (TBC) layer 58.

The metallic substrate 56 is made of a metal material having excellent heat resistance. The metallic substrate 56 has an outer surface 56*a*. The thermal barrier coating layer 58 covers the outer surface 56*a* of the metallic substrate 56 which constitutes the blade body 43. The thermal barrier coating layer 58 protects the metallic substrate 56 from the high temperature combustion gas.

For example, a two-layer laminate in which a thermal barrier layer and a bonding layer are laminated can be used as the thermal barrier coating layer 58. The bonding layer is a layer which reduces the thermal expansion difference between the thermal barrier layer and the metallic substrate 56 and improves adhesion between the thermal barrier layer and the metallic substrate 56.

For example, a ceramic thermal barrier layer having a small thermal conductivity (for example, a yttria stabilized zirconia (YSZ) layer) can be used as the thermal barrier layer. Further, for example, a bonding layer called MCrAlY can be used as the bonding layer.

The cooling flow passage 52 is provided inside the pressure-surface-side blade wall 46, the suction-surface-side blade wall 47, and the top plate 49 (inside the blade body 43). A cooling medium for cooling the blade body 43 disposed under the high temperature atmosphere flows in the cooling flow passage 52.

The cooling holes 53 are formed from the top plate 49 located below the tip-thinning portion 45 provided on the outer surface 49*a* of the top plate 49 to the top plate 49 located closer to the pressure-surface-side blade wall 46 side than the tip-thinning portion 45.

The cooling hole 53 passes through the top plate 49 in a state in which it is inclined to face the tip-thinning portion 45 in the radial direction of the turbine rotor 31. Thus, the cooling hole 53 communicates with the cooling flow passage 52 through which the cooling medium flows. An inclination angle θ of the cooling hole 53 is a constant angle.

The cooling hole 53 has an introduction port 53A and a discharge port 53B. The introduction port 53A is disposed in the inner surface 49*b* of the top plate 49. The introduction port 53A introduces a cooling refrigerant flowing in the cooling flow passage 52 into the cooling hole 53. The introduction port 53A is formed at a position facing the tip-thinning portion 45 or a position closer to the suction-surface-side blade wall 47 side than the position facing the tip-thinning portion 45. The discharge port 53B is disposed in the outer surface 49*a* of the top plate 49 located closer to the pressure-surface-side blade wall 46 side than the tip-thinning portion 45. The discharge port 53B discharges the cooling medium into a space formed between the inner circumferential surface 41*a* of the ring segment 41 and the outer surface 49*a* of the top plate 49.

As described above, since the cooling hole 53 in which the discharge port 53B for discharging the cooling medium is disposed is provided in the outer surface 49*a* of the top plate 49 located closer to the pressure-surface-side blade wall 46 side than the tip-thinning portion 45, the cooling medium can be discharged to the upstream side of a main flow away from the tip-thinning portion 45, and then the cooling medium can be allowed to flow along a protruding surface 45*a* of the tip-thinning portion 45 and the outer surface 49*a* of the top plate 49 located closer to the suction-surface-side blade wall 47 side than the tip-thinning portion 45 (that is, the cooling medium can be allowed to flow in the main flow).

Accordingly, since it is possible to film-cool the outer surface 49*a* of the top plate 49 located closer to the suction-surface-side blade wall 47 side than the tip-thinning portion 45 and the tip-thinning portion 45 using the cooling medium discharged from the discharge port 53B, the amount of cooling medium used to cool the blade body 43 can be reduced. That is, in the case in which the tip-thinning portion 45 and the discharge port 53B for the cooling medium are provided at appropriate positions on the pressure-surface-side blade wall 46 side of the outer surface of the top plate 49, it is possible to film-cool the outer surface 49*a* of the top plate 49 located closer to the suction-surface-side blade wall 47 side than the tip-thinning portion 45 and the tip-thinning portion 45 even when the tip-thinning portion 45 is provided only on the pressure-surface-side blade wall 46 side of the outer surface of the top plate 49. At this time, the tip thinning which requires cooling by the cooling medium is provided only on the pressure-surface-side blade wall 46 side, and there is no tip thinning which requires the cooling on the suction-surface-side blade wall 47 side. Therefore, it is possible to reduce the amount of cooling medium used for cooling the blade body 43 while suppressing damage to the blade body 43, thereby contributing to improvement of the efficiency of the gas turbine.

Further, it is possible to reduce a distance between the cooling hole 53 and the tip-thinning portion 45 in the radial direction of the turbine rotor 31 by disposing the cooling hole 53 to pass through the top plate 49 in a state in which it is inclined to face the tip-thinning portion 45 in the radial direction of the turbine rotor 31. Thus, the tip-thinning portion 45 can be efficiently cooled by convection cooling.

A plurality of cooling holes 53 having such a constitution are disposed at intervals in a direction from the leading edge 43A toward the trailing edge 43B.

As described above, since the plurality of cooling holes 53 are disposed in the direction from the leading edge 43A toward the trailing edge 43B of the blade body 43, the entire outer surface 49*a* of the top plate 49 located closer to the suction-surface-side blade wall 47 side than the tip-thinning portion 45 can be film-cooled using the cooling medium discharged from the discharge ports 53B of the plurality of cooling holes 53.

In a state in which the plurality of cooling holes 53 are seen from the outer side of the turbine rotor 31 in the radial direction, the plurality of cooling holes 53 are disposed so that the axes $O_2$ of the plurality of cooling holes 53 are orthogonal to the pressure surface 46*a* which is the outer surface of the pressure-surface-side blade wall 46.

The angle θ formed by the outer surface 49*a* of the top plate 49 located closer to the suction-surface-side blade wall 47 side than the tip-thinning portion 45 and the axis θ of each of the cooling holes 53 is preferably, for example, 25° or more and 65° or less.

For example, when the angle θ formed by the outer surface 49*a* of the top plate 49 and the cooling hole 53 is smaller than 25°, it may be difficult to machine the cooling hole 53.

On the other hand, when the angle θ formed by the outer surface 49*a* of the top plate 49 and the cooling hoe 53 is larger than 65°, the cooling medium discharged from the cooling holes 53 flows at a position away from the protruding surface 45*a* (the surface facing the ring segment 41 and the inner circumferential surface 41*a*) of the tip-thinning portion 45, and thus it may be difficult to obtain a film-cooling effect.

Therefore, the cooling holes 53 are easily machined, and the outer surface 49*a* of the top plate 49 located closer to the suction-surface-side blade wall 47 side than the tip-thinning portion 45 can be film-cooled by setting the angle formed by the outer surface 49*a* of the top plate 49 located closer to the suction-surface-side blade wall 47 side than the tip-thinning portion 45 and the cooling hole 53 to 25° C. or more and 65° or less.

The angle θ formed by the outer surface 49*a* of the top plate 49 and the cooling hole 53 is more preferably 45°, for example.

The diameter R of the discharge port 53B of the cooling hole 53 can be appropriately set in accordance with a size of the turbine blade 37, the number of the turbine blades 37 disposed in the circumferential direction, and so on.

The tip-thinning portion 45 is formed by removing a part of the metallic substrate 56 used when the blade body 43 is formed. That is, the tip-thinning portion 45 is integrally formed with the blade body 43.

The tip-thinning portion 45 protrudes from the outer surface 49*a* of the top plate 49 located on the pressure-surface-side blade wall 46 side to the outside of the turbine rotor 31 in the radial direction (in other words, the inner circumferential surface 41*a* side of the ring segment 41). The tip-thinning portion 45 extends from the leading edge 43A side toward the trailing edge 43B of the blade body 43.

The tip-thinning portion 45 has the protruding surface 45*a* and side surfaces 45*b* and 45*c*. The protruding surface 45*a* is a surface facing the inner circumferential surface 41*a* of the ring segment 41. The side surface 45*b* is a side surface disposed on the pressure-surface-side blade wall 46 side and exposed from the outer surface 49*a* of the top plate 49. The side surface 45*c* is a side surface disposed on the suction-surface-side blade wall 47 side and exposed from the outer surface 49*a* of the top plate 49.

The thermal barrier coating layer 58 (TBC layer) is not formed on the surface of the tip-thinning portion 45. As described above, since the TBC layer is not formed on the surface of the tip-thinning portion 45, it is possible to ensure machinability on the other side by the tip-thinning portion 45 when the tip-thinning portion 45 and the ring segment 41 come into contact with each other.

The cooling medium from the cooling hole 53 located closer to the pressure-surface-side blade wall 46 side than the tip-thinning portion 45 can flow along the tip-thinning portion 45 and the outer surface of the top plate 49 located downstream thereof, and thus the film-cooling efficiency can be enhanced by making the tip-thinning portion 45 protrude appropriately from the top plate 49.

Figure 5:
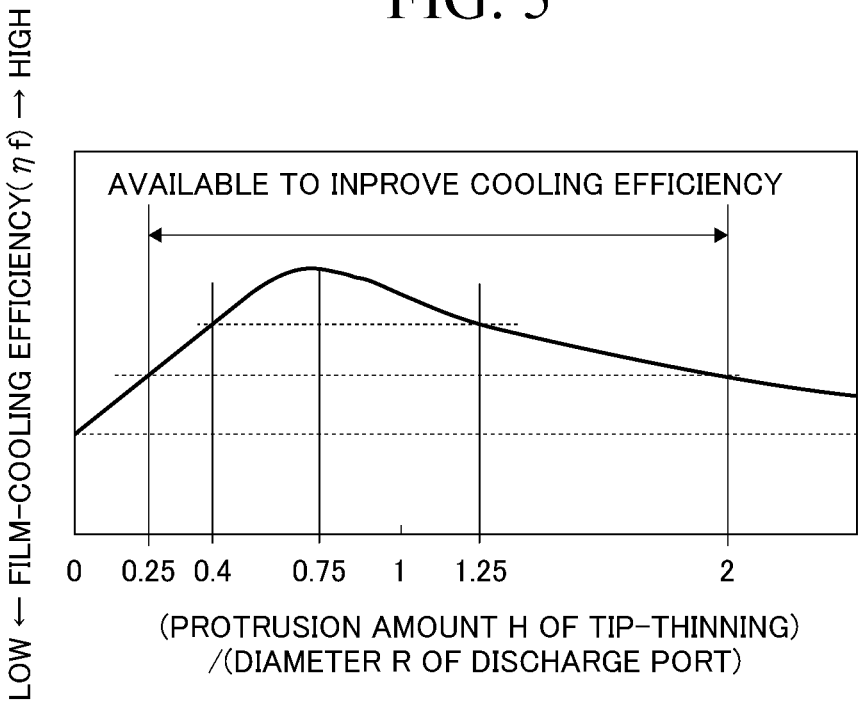
FIG. 5 is a graph showing a relationship between (a protrusion amount H of a top-thinning portion)/(e diameter R of a discharge port) and film-cooling efficiency.

FIG. 5 shows observation results of the film-cooling efficiency when the top plate 49 provided with the tip-thinning portion 45 is analyzed by computational fluid dynamics (CFD) and the protrusion amount H of the tip-thinning portion 45 is changed with respect to the diameter R of the discharge port 53B of the cooling hole 53. Here, several models in which the protrusion amount H of the tip-thinning portion 45 from the top plate 49 is changed were set, and then, for each model, it was visualized and evaluated whether the cooling air discharged from the discharge port 53B could flow along the top plate 49 without being separated and could effectively cool the outer surface 49*a* of the top plate 49.

Here, the film-cooling efficiency (Πf) is defined as follows.

$$\eta f=(Tg-Tw)/(Tg-Tc)$$

wherein Tg is the temperature of the combustion gas (the main flow), Tw is the gas temperature near the wall to be evaluated, and Tc is the temperature of the cooling air blown out from the discharge port.

According to the graph of FIG. 5, the protrusion amount H of the tip-thinning portion 45 is preferably, for example, 0.25 times or more and 2.00 times or less the diameter R of the discharge port 538 of the cooling hole 53, and more preferably 0.4 times or more and 1.25 times or less.

When the protrusion amount H of the tip-thinning portion 45 is smaller than 0.25 times the diameter R of the discharge port 53B of the cooling hole 53, the effect of enhancing the film-cooling efficiency is also small. Further, since the gap between the top plate 49 and the turbine casing 34 is narrowed and the possibility of the top plate 49 coming into contact is also increased, the effect of providing the tip-thinning portion 45 may be reduced.

On the other hand, when the protrusion amount H of the tip-thinning portion 45 is larger than 2.00 times the diameter R of the discharge port 53B of the cooling hole 53, the distance between the discharge hole of the cooling hole 53 and the tip portions of the top plate and the tip-thinning portion 45 increases, the cooling medium is easily separated from the tip-thinning portion 45 or the top plate 49, and it may be difficult to flow the cooling medium along the outer surface 49*a* of the top plate 49 located closer to the suction-surface-side blade wall 47 side than the tip-thinning portion 45.

Therefore, while the effect of providing the tip-thinning portion 45 is maintained, the outer surface 49*a* of the top plate 49 located closer to the suction-surface-side blade wall 47 side than the tip-thinning portion 45 can be cooled by setting the protrusion amount of the tip-thinning portion 45 to be 0.25 times or more and 2.00 times or less the diameter R of the discharge port 53B of the cooling hole 53.

When the protrusion amount H of the tip-thinning portion 45 is 0.25 times or more and 2.00 times or less the diameter R of the discharge port 53B of the cooling hole 53, the cooling medium discharged from the discharge port 53B flows along the top plate 49, and thus the film-cooling efficiency is maintained high.

Incidentally, as can be seen from the graph of FIG. 5, when a value of (the protrusion amount H of the tip-thinning portion 45)/(the diameter R of the discharge port 53B) (hereinafter, referred to as tip-thinning protrusion ratio) is 0.75. It indicates a value (a peak value) at which the film-cooling efficiency is the highest. In a range from the value at which the film-cooling efficiency indicates the peak value to the preferable lower limit value (0.25) of the tip-thinning protrusion ratio, the film-cooling efficiency decreases as the tip-thinning protrusion ratio decreases. Here, since the protrusion amount H of the tip thinning 59 gradually decreases by the thickness reduction due to high temperature or the wear due to the contact while the gas turbine is operated for a long time, in the case in which the tip-thinning protrusion ratio is adjusted to the range from the value at which the film-cooling efficiency indicates the peak value to the preferable lower limit value (0.25) of the tip-thinning protrusion ratio, when the protrusion amount H of the tip-thinning portion 45 decreases with the passage of time, the film-cooling efficiency also decreases accordingly.

On the other hand, in the range from the upper limit value (2.00) of the tip-thinning protrusion ratio to the value at which the film-cooling efficiency indicates the peak value, the film-cooling efficiency increases gradually as the tip-thinning ratio decreases. That is, in the case in which the tip-thinning protrusion ratio is adjusted to the range from the upper limit value (2.00) of the tip-thinning protrusion ratio to the value at which the film-cooling efficiency indicates the peak value, when the protrusion amount H of the tip-thinning portion 45 decreases with the passage of time, the film-cooling efficiency increases gradually.

Therefore, considering that the thickness of the tip-thinning portion 45 is reduced by the high temperature or the tip-thinning portion 45 is worn away by the contact while the gas turbine is operated for a long time, it is preferable not to precisely adjust, the tip-thinning protrusion ratio to the value at which the cooling efficiency indicates the peak value (0.75) in a manufacturing stage of the turbine blade. The tip-thinning protrusion ratio should be adjusted to be in the range from the upper limit value (2.00) to the value (0.75) at which the cooling efficiency indicates the peak value. Given the above, it is preferable to adjust the tip-thinning protrusion ratio, that is, the value of (the protrusion amount H of the tip-thinning portion 45)/(the diameter R of the discharge port 53B) to about 1.00 in the initial manufacturing stage.

Further, it is preferable that the width $W_2$ of the outer surface 49*a* of the top plate 49 located closer to the pressure-surface-side blade wall 46 side than the tip-thinning portion 45 be, for example, 1 time or more and 3 times or less the diameter R of the discharge port 53B of the cooling hole 53.

When the width $W_2$ of the outer surface 49*a* of the top plate 49 located closer to the pressure-surface-side blade wall 46 side than the tip-thinning portion 45 is smaller than one times the diameter R of the discharge port of the cooling hole 53, it may be difficult to form the discharge port 53B of the cooling hole 53 in the outer surface 49*a* of the top plate 49 located closer to the pressure-surface-side blade wall 46 side than the tip-thinning portion 45.

On the other hand, when the width $W_2$ of the outer surface 49*a* of the top plate 49 located closer to the pressure-surface-side blade wall 46 side than the tip-thinning portion 45 is larger than three times the diameter R of the discharge port 53B of the cooling hole 53, it may be difficult to efficiently cool the tip-thinning portion 45, or the temperature of the edge of the pressure-surface-side blade wall 46 and the inclined surface 49A*a* may be too high because the distance between the cooling hole 53 and the tip-thinning portion 45 is too large.

Therefore, while the cooling holes 53 are easily formed, the tip-thinning portion 45 can be cooled efficiently, and the temperature of the inclined surface 49A*a* can be prevented from being too high by setting the width $W_2$ of the outer surface 49*a* of the top plate 49 located closer to the pressure-surface-side blade wall 46 side than the tip-thinning portion 45 to be 1 time or more and 3 times less the diameter R of the discharge port 53B of the cooling hole 53.

More preferably, the width $W_2$ of the outer surface 49*a* of the top plate 49 located closer to the pressure-surface-side blade wall 46 side than the tip-thinning portion 45 is, for example, twice the diameter R of the discharge port 53B of the cooling hole 53.

According to the turbine blade 37 of the embodiment, since the introduction port 53A which is formed at the position facing the tip-thinning portion 45 or the position closer to the suction-surface-side blade wall 47 side than the position facing the tip-thinning portion 45 and introduces the cooling medium into the cooling hole 53, and the discharge port 53B which is formed in the outer surface 49*a* of the top plate 49 on the pressure-surface-side blade wall 46 side of the tip-thinning portion 45 and discharges the cooling medium via the cooling hole 53 are provided, the cooling medium can be discharged upstream of the tip-thinning portion 45 and can flow along the protruding surface 45*a* of the tip-thinning portion 45 and the outer surface 49*a* of the top plate 49 located closer to the suction-surface-side blade wall 47 side than the tip-thinning portion 45.

Accordingly, since it is possible to film-cool the outer surface 49*a* of the top plate 49 located closer to the suction-surface-side blade wall 47 side than the tip-thinning portion 45 and the tip-thinning portion 45 using the cooling medium discharged from the discharge port 53B, the amount of cooling medium used to cool the blade body 43 can be reduced. That is, in the case in which the tip-thinning portion 45 and the discharge port 53B for the cooling medium are provided at appropriate positions of the outer surface of the top plate 49 on the pressure-surface-side blade waft 46 side, it becomes possible to film-cool the outer surface 49*a* of the top plate 49 located closer to the suction-surface-side blade wall 47 side than the tip-thinning portion 45 and the tip-thinning portion 45 even when the tip-thinning portion 45 is provided only on the pressure-surface-side blade wall 46 side of the outer surface of the top plate 49. At this time, the tip thinning which requires the cooling by the cooling medium is provided only on the pressure-surface-side blade wall 46 side, and there is no tip thinning which requires the cooling on the suction-surface-side blade wall 47 side. Therefore, the amount of cooling medium used for cooling the blade body 43 can be reduced while damage to the blade body 43 is suppressed, and it contributes to the improvement of the efficiency of the gas turbine.

Further, since the introduction port 53A which is formed at the position facing the tip-thinning portion 45 or the position closer to the suction-surface-side blade wall 47 side than the position facing the tip-thinning portion 45 and introduces the cooling medium into the cooling hole 53 is provided, it is possible to reduce the distance between the cooling holes 53 and the tip-thinning portion 45 in the radial direction of the turbine rotor 31, and thus the tip-thinning portion 45 can be cooled from the inside thereof using the cooling medium flowing through the cooling hole 53 passing through the top plate 49. Accordingly, the tip-thinning portion 45 can be cooled efficiently.

Further, the gas turbine 10 having the plurality of turbine blades 37 described above can reduce the amount of cooling medium used to cool the plurality of turbine blades 37.

Figure 6:
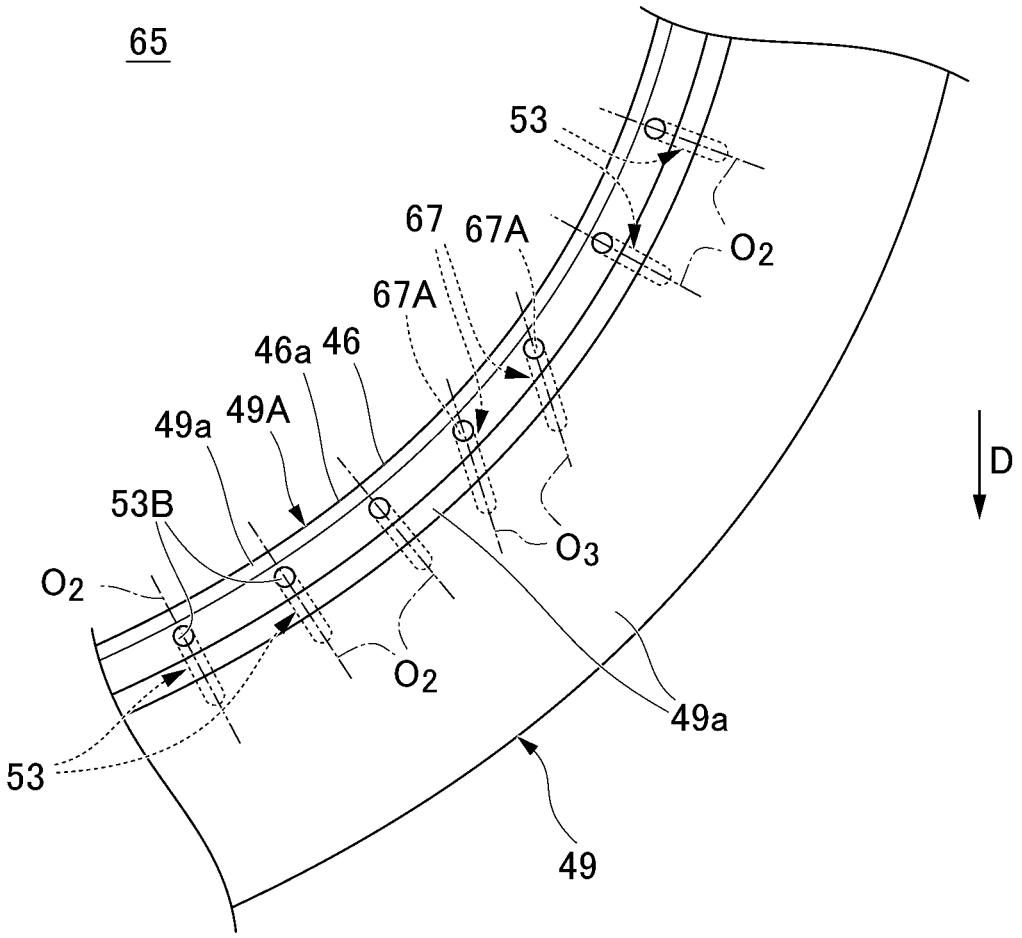
FIG. 6 is a view for explaining a turbine blade according to a first modified example of the present embodiment.

A turbine blade 65 according to a first modified example of the embodiment will be described with reference to FIG. 6. FIG. 6 is a schematic view of the turbine blade 65 in plan view seen from the outside of the turbine rotor in the radial direction. In FIG. 6, the same components as those in the structure shown in FIG. 4 are designed by the same reference numerals. Further, in FIG. 6, $O_3$ indicates an axis of a cooling hole 67 (hereinafter, referred to as "axis $O_3$").

The turbine blade 65 is constituted in the same manner as the turbine blade 37 except for having the cooling hole 67 in addition to the cooling hole 53.

The cooling holes 67 is constituted in the same manner as the cooling hole 53 except that it is inclined with respect to the pressure surface 46*a* of the pressure-surface-side blade wall 46 and is directed to the trailing edge side of the blade body in a plan view seen from the outside of the turbine rotor (not shown) in the radial direction. The cooling hole 67 has a discharge port 67A for discharging a cooling refrigerant.

According to the turbine blade 65 having such a constitution, since the turbine blade 65 is inclined with respect to the pressure surface 46*a* of the pressure surface side blade wall 46 and has the cooling hole 67 facing the trailing edge side of the blade body, the cooling refrigerant discharged from the discharge port 67A of the cooling hole 67 can flow along the tip thinning and the top plate, and the effect due to film cooling can be increased.

The number of cooling holes 67 shown in FIG. 6 is an example and is not limited to the number of cooling holes 67 shown in FIG. 6.

Further, although FIG. 6 illustrates the case in which a plurality of cooling holes 53 and cooling holes 67 are provided as an example, all the cooling holes may be constituted by the cooling holes 67.

Further, for example, the plurality of cooling holes 53 may include a plurality of first cooling holes formed in a leading edge-side region located on the leading edge 43A side and a trailing edge-side region located on the trailing edge 45B side, and a plurality of second cooling holes formed in an intermediate region disposed between the leading edge-side region and the trailing edge-side region. Each of the first cooling holes may have a circular cut surface formed by being cut by a plane orthogonal to an axial direction of the first cooling hole, each of the second cooling holes may have a first portion formed on the refrigerant flow passage side, and a second portion formed on the outside of the first portion in a slate in which it is connected to the first portion and including a discharge port. The first portion may have a circular cut surface formed by the plane orthogonal to the axial direction of the second cooling hole, a diameter of the second cooling hole in the axial direction may be formed constantly, and the second portion may be formed so that a width in a direction along the pressure surface 46*a* of the pressure-surface-side blade wall 46 gradually widens from the first portion toward the discharge port.

As described above, since each of the plurality of second cooling holes formed in the intermediate region has a circular cut surface formed by the plane orthogonal to the axial direction of the second cooling hole and also has the first portion having the diameter which is constant in the axial direction of the second cooling hole and the second portion formed so that the width in the direction along the pressure surface of the pressure-surface-side blade wall gradually widens from the first portion toward the discharge port, a width of the discharge port of each of the plurality of second cooling holes in the direction along the pressure surface of the pressure-surface-side blade wall widens, and thus it is possible to discharge the cooling medium to a wide range from the discharge port.

Accordingly, an arrangement pitch of the second cooling holes can be wider than an arrangement pitch of the first cooling holes, and the number of second cooling holes arranged in the intermediate region can be reduced.

Further, in FIG. 6, although the case in which the cooling hole 67, which is inclined with respect to the pressure surface 46*a* of the pressure-surface-side blade wall 46 and faces the trailing edge side of the blade body, has been described as an example, a cooling hole which is inclined with respect to the pressure surface 46*a* of the pressure-surface-side blade wall 46 and faces the leading edge side of the blade body may be provided instead of the cooling hole 67. In this case, some of the plurality of cooling holes may be constituted by cooling holes facing the leading edge side of the blade body, or all cooling holes may be constituted by the cooling holes facing the leading edge side of the blade body.

Figure 7:
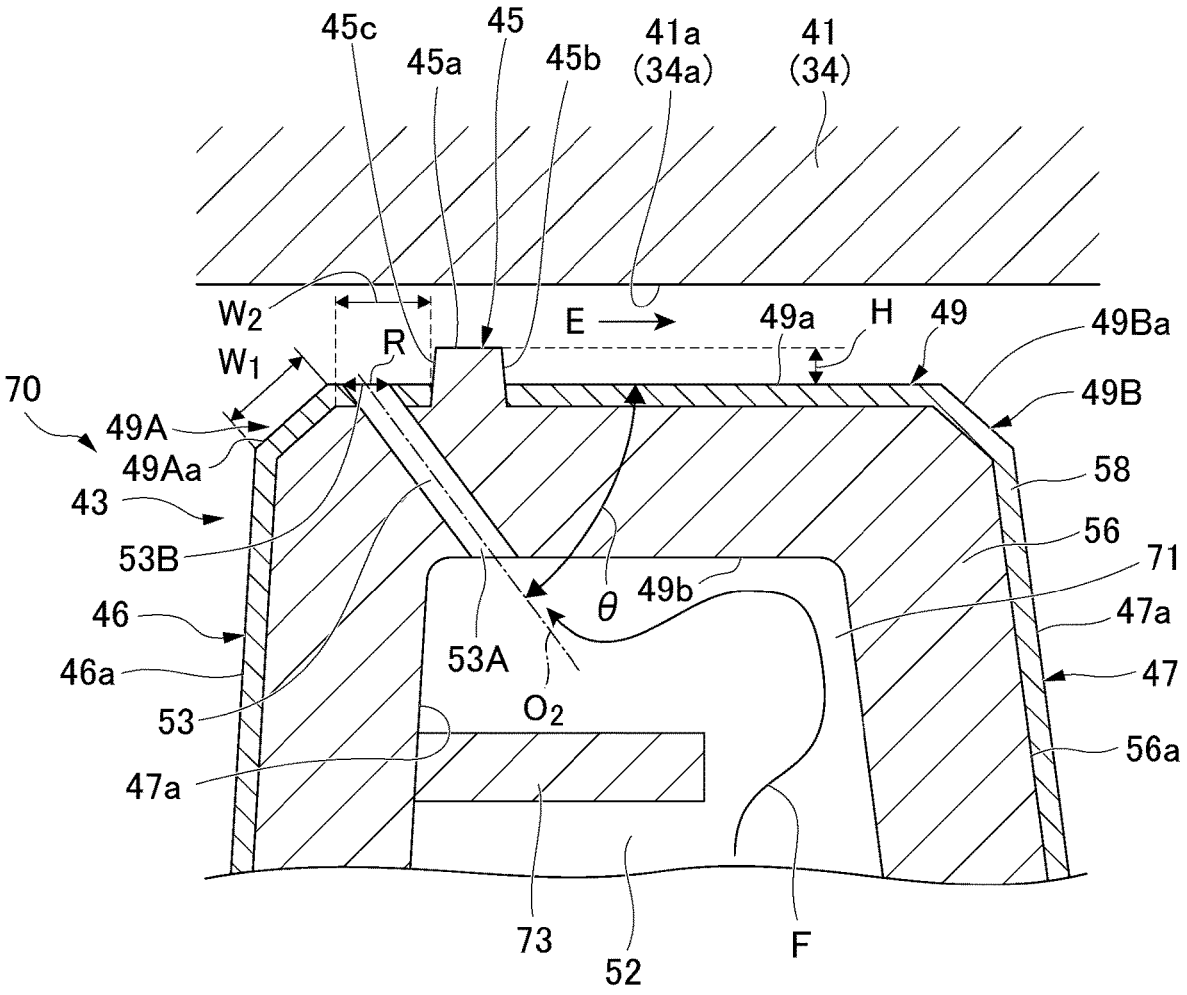
FIG. 7 is a view for explaining a turbine blade according to a second modified example of the present embodiment.

Next, a turbine blade 70 according to a second modified example of the embodiment will be described with reference to FIG. 7. In FIG. 7, the same components as those in the structure shown in FIG. 3 are designated by the same reference numerals.

The turbine blade 70 is constituted in the same manner as the turbine blade 37 described above except for having a flow passage-forming member 73.

The flow passage-forming member 73 is provided on the inner surface 46*b* of the pressure-surface-side blade wall 46. The flow passage-forming member 73 protrudes in a direction from the inner surface 46*b* of the pressure-surface-side blade wall 46 toward the suction-surface-side blade wall 47.

The flow passage-forming member 73 forms a flow passage 71 which guides the cooling medium to the inside of a boundary portion between the top plate 49 and the suction-surface-side blade wall 47 and then guides the cooling medium to the cooling hole 53. The flow passage 71 is a flow passage partitioned by providing the flow passage-forming member 73 in the cooling flow passage 52.

According to the turbine blade 70 having such a constitution, since the flow passage-forming member 73 which forms the above-described flow passage 71 is provided and thus the cooling medium is introduced to the inside of the boundary portion between the top plate 49 and the suction surface side blade wall 47 before the cooling medium supplied to the cooling hole 53 is introduced to the cooling hole 53, it is possible to cool the inside of the boundary between the top plate 49 and the suction-surface-side blade wall 47 in which the temperature tends to be high. Thus, the cooling medium required to cool the turbine blade 70 can be reduced.

Although the preferred embodiments of the present invention and the modified examples thereof have been described above in detail, the present invention is not limited to such specific embodiments, and various modifications and changes are possible within the scope of the present invention described in the claims.

EXPLANATION OF REFERENCES

10 Gas turbine
11 Compressor
12 Combustor
13 Turbine
15 Generator
21 Compressor rotor
21*a*, 31*a* Outer circumferential surface
23 Compressor blade stage
24 Compressor casing
24*a*, 34*a*, 41*a* Inner circumferential surface
25 Compressor vane stage
27 Compressor blade
28 Compressor vane
30 Rotor
31 Turbine rotor
33 Turbine blade stage
34 Turbine casing
35 Turbine vane stage
37, 65, 70 Turbine blade
38 Turbine vane
41 Ring segment
43 Blade body
43A Leading edge
43B Trailing edge
45 Tip thinning
45*a* Protruding surface
45*b*, 45*c* Side surface
46 Pressure-surface-side blade wait
46*a* Pressure surface
47 Suction-surface-side blade wall
47*a* Suction surface
49 Top plate
49*a*, 56*a* Outer surface
49A, 49B Chamfered portion
49A*a*, 49B*a* Inclined surface
46*b*, 49*b* Inner surface
52 Cooling flow passage
53, 67 Cooling hole
53A Introduction port
53B, 67A Discharge port
56 Metallic substrate
58 Thermal barrier coating layer
71 Flow passage
73 Flow passage-forming member
B Region
D, E Direction
H Protrusion amount
$O_1$ to $O_3$ Axis
$W_1$, $W_2$ Width
θ Inclination angle

What is claimed is:

1. A turbine blade, comprising:

a blade body including a pressure-surface-side blade wall and a suction-surface-side blade wall extending in a radial direction of the turbine blade and being connected to each other at a leading edge of the blade body and a trailing edge of the blade body, and a top plate having an outer surface configured to face an inner circumferential surface of a casing, the top plate being provided at a tip portion, among end portions of the pressure-surface-side blade wall and the suction-surface-side blade wall; and a tip-thinning portion protruding outward in the radial direction of the turbine blade from the outer surface of the top plate, the tip-thinning portion extending from a leading edge side of the blade body to a trailing edge side of the blade body, and the tip-thinning portion being closer to a pressure-surface-side blade wall side of the top plate than a suction-surface-side blade wall side of the top plate, wherein:

the blade body includes: (i) a cooling hole defined to pass through the top plate, (ii) an introduction port defined at a position of an inner surface of the top plate and configured to introduce a cooling medium into the cooling hole, and (iii) a discharge port defined in the outer surface of the top plate closer to the pressure-surface-side blade wall side of the top plate than the tip-thinning portion and configured to discharge the cooling medium via the cooling hole;

a protrusion amount of the tip-thinning portion, based on the outer surface of the top plate, is within a range of at least 0.25 times to at most 2.00 times a diameter of the discharge port of the cooling hole;

the outer surface of the top plate extends in a planar shape from the tip-thinning portion toward the suction-surface-side blade wall side of the top plate, and is configured to direct the cooling medium which has passed through the tip-thinning portion along the outer surface of the top plate toward the suction-surface-side blade wall side of the top plate; and the tip-thinning portion is the only tip-thinning portion protruding outward in the radial direction of the turbine blade from the top plate.

2. The turbine blade according to claim 1, wherein the tip-thinning portion is provided only adjacent to the pressure-surface-side blade side of the top plate.

3. The turbine blade according to claim 1, wherein the cooling hole is one of a plurality cooling holes arranged sequentially in a direction from the leading edge side of the blade body to the trailing edge side of the blade body.

4. The turbine blade according to claim 3, wherein one of the plurality of cooling holes is inclined with respect to a pressure surface that is an outer surface on the pressure-surface-side blade wall, the one of the plurality of cooling holes facing the leading edge side of the blade body or the trailing edge side of the blade body.

5. The turbine blade according to claim 1, wherein the top plate has an inclined surface which is disposed on an outside of the outer surface of the top plate to surround the outer surface of the top plate and inclined with respect to the outer surface of the top plate.

6. The turbine blade according to claim 5, wherein a width of the inclined surface is within a range of at least 0.25 times to at most 3.00 times the diameter of the discharge port of the cooling hole.

7. The turbine blade according to claim 4, wherein the top plate has an inclined surface which is disposed on an outside of the outer surface of the top plate to surround the outer surface of the top plate and inclined with respect to the outer surface of the top plate.

8. The turbine blade according to claim 1, wherein an angle between the outer surface of the top plate located closer to the suction-surface-side blade wall side of the top plate than the tip-thinning portion and an axis of the cooling hole is 25° or more and 65° or less.

9. The turbine blade according to claim 4, wherein an angle between the outer surface of the top plate located closer to the suction-surface-side blade wall side of the top plate than the tip-thinning portion and an axis of the cooling hole is 25° or more and 65° or less.

10. The turbine blade according to claim 1, wherein a width of the outer surface of the top plate located closer to the pressure-surface-side blade wall side of the top plate than the tip-thinning portion is within a range of at least one times to at most three times the diameter of the discharge port of the cooling hole.

11. The turbine blade according to claim 4, wherein a width of the outer surface of the top plate located closer to the pressure-surface-side blade wall side of the top plate than the tip-thinning portion is within a range of at least one times to at most three times the diameter of the discharge port of the cooling hole.

12. The turbine blade according to claim 1, further comprising a flow passage-forming member provided in the blade body and configured to form a flow passage for the cooling medium in the blade body so as to guide the cooling medium to a boundary portion between the top plate and the suction-surface-side blade wall and then guide the cooling medium to the cooling hole.

13. The turbine blade according to claim 1, wherein the tip-thinning portion and the blade body are integrally formed by: (i) machining a metallic substrate, and (ii) covering only an outer surface of the metallic substrate constituting the blade body with a thermal barrier coating layer.

14. A gas turbine, comprising:

a turbine including a turbine rotor and a plurality of turbine blades according to claim 1, the plurality of turbine blades being disposed on the turbine rotor in a circumferential direction and an axial direction;

a compressor configured to suction combustion air and to generate compressed air;

a combustor configured to inject fuel into the compressed air to burn the fuel and to generate combustion gas for driving the turbine; and a casing including a ring segment facing the tip-thinning portion with a gap interposed therebetween, and being configured to accommodate the turbine rotor and the plurality of turbine blades.

15. The turbine blade according to claim 1, wherein the position of the inner surface of the top plate faces the tip-thinning portion.

16. The turbine blade according to claim 1, wherein the position of the inner surface of the top plate is closer to the suction-surface-side blade wall side of the top plate than a position of the inner surface of the top plate facing the tip-thinning portion.

17. The turbine blade according to claim 1, wherein the outer surface of the top plate is configured to be parallel to the inner circumferential surface of the casing.

18. The turbine blade according to claim 1, wherein the outer surface of the top plate is parallel to the inner surface of the top plate.

* * * * *